US008593364B2

(12) United States Patent
Bin Basri et al.

(10) Patent No.: US 8,593,364 B2
(45) Date of Patent: Nov. 26, 2013

(54) 450 MHZ DONOR ANTENNA

(75) Inventors: Rizal Helmy Bin Basri, Selangor Darul Ehsan (MY); Azhari Bin Asrokin, Negeri Sembilan Darul Khusus (MY); Norman Bin Jamlus, Kuala Lumpur (MY); Anas Bin Abas, Selangor Darul Ehsan (MY)

(73) Assignee: Telekom Malaysia Berhad, Kuala Lumpur (MY)

( * ) Notice: Subject to any disclaimer, the term of this patent is extended or adjusted under 35 U.S.C. 154(b) by 200 days.

(21) Appl. No.: 13/340,062

(22) Filed: Dec. 29, 2011

(65) Prior Publication Data

US 2012/0169561 A1 Jul. 5, 2012

(30) Foreign Application Priority Data

Dec. 30, 2010 (MY) ..... PI 2010006324

(51) Int. Cl.
*H01Q 9/28* (2006.01)

(52) U.S. Cl.
USPC ..... 343/795; 343/797; 343/803; 343/814

(58) Field of Classification Search
USPC ..... 343/793, 795, 797, 803, 812, 813, 814
See application file for complete search history.

(56) References Cited

U.S. PATENT DOCUMENTS

| | | | | |
|---|---|---|---|---|
| 3,742,512 | A * | 6/1973 | Munson | 343/814 |
| 3,887,925 | A * | 6/1975 | Ranghelli et al. | 343/795 |
| 5,087,922 | A * | 2/1992 | Tang et al. | 343/814 |
| 6,067,053 | A * | 5/2000 | Runyon et al. | 343/797 |
| 6,211,840 | B1 * | 4/2001 | Wood et al. | 343/793 |
| 6,844,851 | B2 * | 1/2005 | Yoon et al. | 343/700 MS |
| 6,853,346 | B2 * | 2/2005 | Annabi et al. | 343/803 |

* cited by examiner

*Primary Examiner* — Tho G Phan
(74) *Attorney, Agent, or Firm* — Nath, Goldberg & Meyer; Jerald L. Meyer; Scott C. Langford

(57) ABSTRACT

The present invention provides a donor antenna comprising a base plate having a top surface and a bottom surface; an array of folded dipole antenna mounted on the top surface of the base plate through a plastic holder, wherein the array of folded dipole antennas are arranged in a lattice form; and a feed network defining on the bottom surface for electrically connecting the array of folded dipole antennas to collectively feed to a connector; wherein each of the folded dipole antenna comprises a substrate having symmetrically configured conducting strips defined on the both side of the substrate forming an excitation arm and a ground arm of the folded dipole antenna.

14 Claims, 9 Drawing Sheets

450 MHZ DONOR ANTENNA

FIELD OF THE INVENTION

The present invention relates to a 450 MHz donor antenna. In particular, the present invention relates to a donor antenna that is of a planar type; adapted for receiving a frequency in a range of 450-470 MHz, with an ability to attain high directivity and high gain.

BACKGROUND

The use of portable wireless devices for telecommunications has been increasing over the years. Demand for such telecommunications is also increasingly common and seen in areas such as residences and businesses. As such, meeting the needs of those that requires wireless telecommunications even in rural areas has been on a rise.

A proven efficiency and performance of CDMA 2000 with the coverage of the 450 MHz frequency band is the CDMA 450. CDMA 450 is one of the rapidly emerging categories in the communication technology. This allows users to receive telecommunication coverage in areas where lower frequencies and longer distance coverage are required. An example would be users who are frequent travelers to rural areas and residents of rural areas. The proven efficiency and performance increases the need for an antenna to be able to receive and transmit low-frequency signals from CDMA base stations.

A repeater antenna system provides wide area coverage through antennas to accomplish signal reception at greater distances. Typically, the repeater antenna system comprises a donor antenna, an amplifier and a service antenna. The repeater antenna system receives incoming signals from nearby base station through the donor antenna, amplifies it through the amplifier and then broadcast the amplified signals through the service antenna.

SUMMARY

It can thus be seen that there exists a need for a need for an antenna to obtain the maximum signal and coverage for a repeater antenna system, which is able to support an operating frequency of 450-470 MHz. This design achieves high gain and high directivity with a good coverage of the low operating frequency and a good Voltage Standing Wave Ratio (VSWR) as compared to the existing prior art.

A donor antenna that is capable of supporting a CDMA 450 system that is a planar type of antenna is disclosed. According to one embodiment of the present invention, the donor antenna includes a base plate, an array of folded dipole antennas and a feed network.

In one aspect of the present invention, there is provided a donor antenna comprising a base plate having a top surface and a bottom surface; an array of folded dipole antenna mounted on the top surface of the base plate through a plastic holder, wherein the array of folded dipole antennas are arranged in a lattice form; and a feed network defining on the bottom surface for electrically connecting the array of folded dipole antennas to collectively feed to a connector; wherein each of the folded dipole antenna comprises a substrate having symmetrically configured conducting strips defined on the both side of the substrate forming an excitation arm and a ground arm of the folded dipole antenna.

In one embodiment, the lattice form comprises a 4 by 5 array of folded dipole antennas.

In another embodiment, each of the folded dipole antenna are mounted perpendicularly to the base plate.

In a further embodiment, both the excitation arm and the grounding arm are adapted with a symmetric conducting strip configuration, wherein the conducting strip on each side of the substrate comprises a m-shaped conducting strip having a center conducting leg, and two symmetrically configured folded arms, wherein the center conducting leg is thinner in width than the two folded arms. The folded dipole antenna further comprises a coaxial cable having a center core extended through the substrate to connect with the excitation arm at one end, and a metal shield soldered along the center conducting leg of the ground arm, wherein the other end of the coaxial cable is extending through the base plate to electrically connect to the feed network on the bottom side of the base plate. The m-shaped conducting strip defining a gap separating the symmetrically configured folded arms of the m-shaped conducting strip into a first conducting strip and a second conducting strip, the first conducting strip includes one of the symmetrically configured folded arm and the center conducting leg forming an inverted U-shaped conducting strip whilst the second conducting strip include the other symmetrically configured folded arm forming an inverted L-shaped conducting strip.

In yet another embodiment, each of the folded dipole antenna is approximately 200-400 mm apart from the adjacent antenna.

Further, each row of the folded dipole antenna is approximately 150-400 mm apart from the adjacent row.

In another embodiment, the array of the folded dipole antennas is arranged in a rectangular lattice arrangement.

In yet another embodiment, the array of the folded dipole antennas is arranged in a triangular lattice arrangement.

In another embodiment, the feed network can be formed on a Printed Circuit Board. The feed network further comprises a plurality of power dividers for collectively connecting the folded dipole antennas to feed to the connector. Further, the plurality of power dividers can be further formed with microstrip lines to create modules. Each adjacent pair of the folded dipole antennas is connected to one power divider.

BRIEF DESCRIPTION OF THE DRAWINGS

This invention will be described by way of non-limiting embodiments of the present invention, with reference to the accompanying drawings, in which.

DETAILED DESCRIPTION

Figure 1:
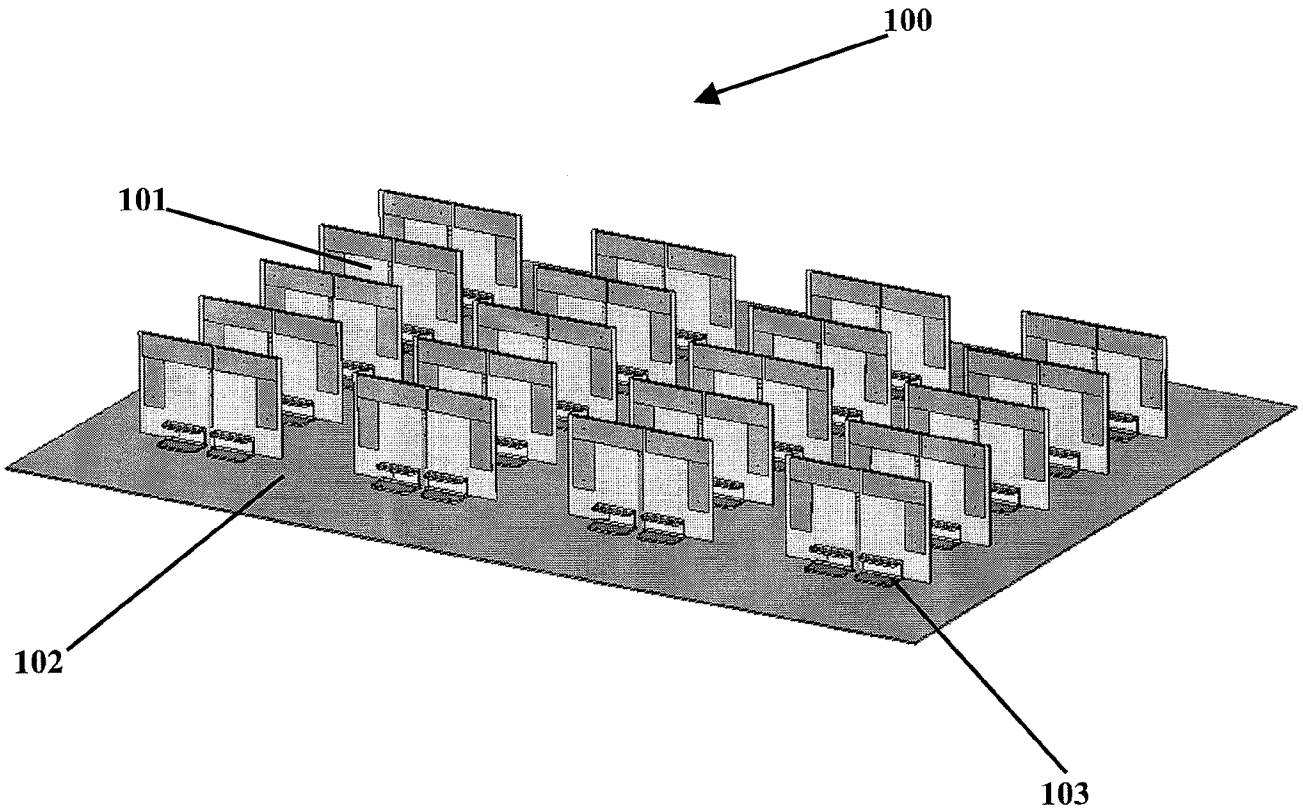
FIG. 1 illustrates a donor antenna in accordance with an embodiment of the present invention.

The following descriptions of a number of specific and alternative embodiments are provided to understand the inventive features of the present invention. It shall be apparent to one skilled in the art, however that this invention may be practiced without such specific details. Some of the details may not be described in length so as to not obscure the invention. For ease of reference, common reference numerals will be used throughout the figures when referring to same or similar features common to the figures.

FIG. 1 illustrates a donor antenna 100 according to one embodiment of the present invention. FIG. 1, which shows a perspective view of the donor antenna 100, provides a directional antenna that can be used for CDMA 2000 that operates at a frequency range of 450-470 MHz, i.e. CDMA 450. The donor antenna 100 includes a plurality of folded dipole antenna 101 and a base plate 102. Each folded dipole antenna 101 is mounted perpendicularly to the base plate 102 with an aid of a plastic holder 103 forming substantially an inverted-T cross-section. Description of the plastic holder 103 will be further elaborated below. The plurality of the folded dipole antennas 101 as shown in FIG. 1 are arranged in a Rectangular lattice arrangement. A clearer perspective of the Rectangular lattice arrangement of the plurality of the folded dipole antennas 101 will be shown in FIG. 4. The plurality of the folded dipole antennas 101 may also be arranged in a Triangular lattice arrangement as shown in FIG. 5.

Still referring to FIG. 1, the base plate 102 can be made from Aluminum, as it is light in weight and easy to be formed. The base plate 102 acts as a reflector to the donor antenna 100, which makes the donor antenna 100 a directional antenna. Directional antenna provides generally higher gain than a non-directional antenna of the same or similar configuration. The dimensions of the base plate 102 controls the beam width of the radiation pattern while causing minor effect to the Voltage Standing Wave Ratio (VSWR). The VSWR is a voltage ratio that measures how well a load is matched to the circuit driving it. The beam-width of the donor antenna 100 affects the antenna gain. Accordingly, the modification of the size of the base plate may offer different performance of the donor antenna 100. The size of the base plate 102 is dependent on the number of folded dipole antennas 101 required and the distance between the folded dipole antennas 101. It is desired that the distance between the folded dipole antennas 101 is around half-wavelength of the operating frequency. In the present embodiment, the directional donor antenna 100 has a horizontal beam width of around 30°±10° and a vertical beam width of around 18°±10°. The donor antenna 100 has a gain of approximately 15 dB. The overall length of the base plate 102 is approximately 1800 mm and its overall width is 800 mm.

Figure 2:
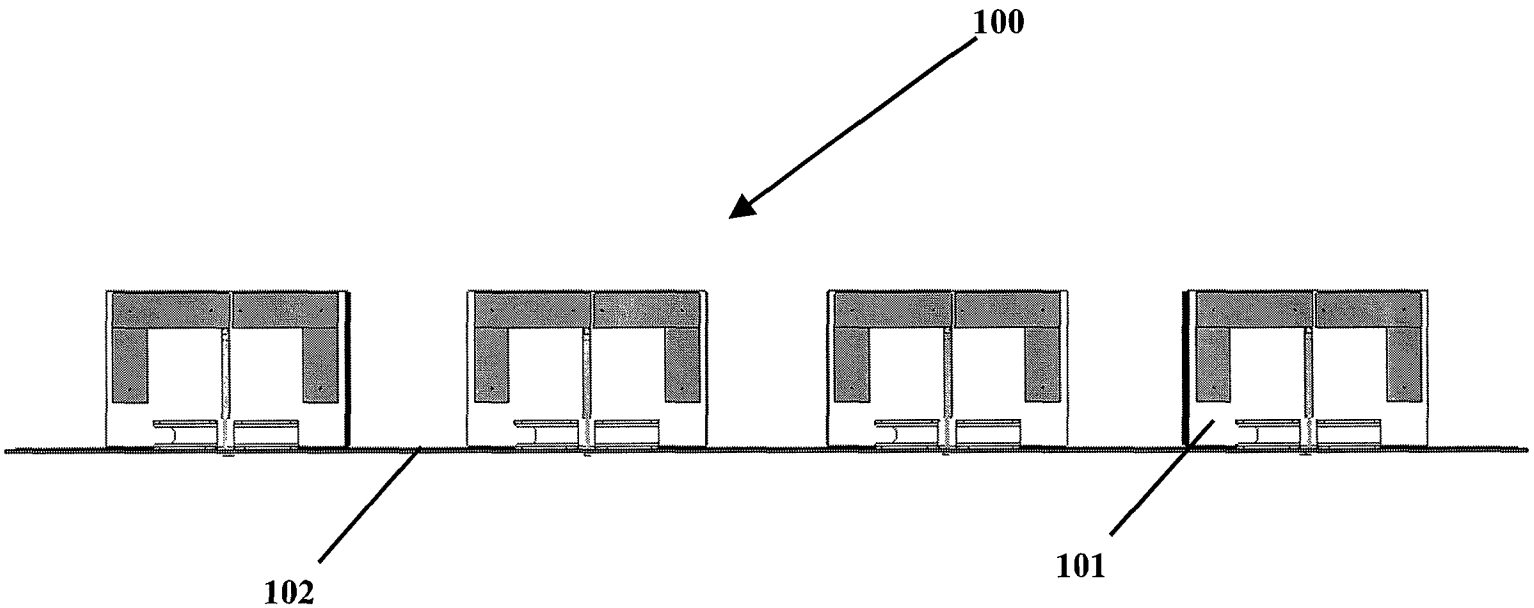
FIG. 2 illustrates a front view of the donor antenna of FIG. 1.

FIG. 2 illustrates a front view of the donor antenna 100 as shown in FIG. 1. In this example shown in FIG. 2, the plurality of the folded dipole antennas 101 is arranged in a Rectangular lattice arrangement. The Rectangular lattice arrangement of the donor antenna 100 arranges each folded dipole antenna 101 placed vertically on the base plate 102 in a 4 rows by 5 columns (4×5) arrangement as one example of the donor antenna 100.

The horizontal and vertical beam-width are dependent on the array size of the folded dipole antenna 101. Changes in the arrangement of the folded dipole antennas 101 in the horizontal and vertical axis may also vary the overall gain of the donor antenna 100.

The front view of the donor antenna 100 shows four of the folded dipole antenna 101 arranged in 4 rows. Each of the folded dipole antenna 101 is placed in equidistance apart. The distance between each of the folded dipole antenna 101 should be around half-wavelength of the operation frequency of the antenna. In the field of an antenna's design, the directional dependence of radiation from the antenna is better known as the radiation pattern. The radiation pattern's beam-width of the donor antenna 100 is also dependent on the distance between each of the folded dipole antenna 101 and the number of folded dipole antennas 101 at each axis (horizontal or vertical) in the array size. The distance between each of the folded dipole antenna 101 also affects the overall gain of the donor antenna 100. The distance between two folded dipole antennas 101 measured from their centers arranged in line in each row is approximately 200-400 mm and arranged in line in each column is approximately 400-500 mm. Similarly, the effect on the VSWR is negligible as long as each of the folded dipole antenna 101 is not placed too closely together.

Figure 3:
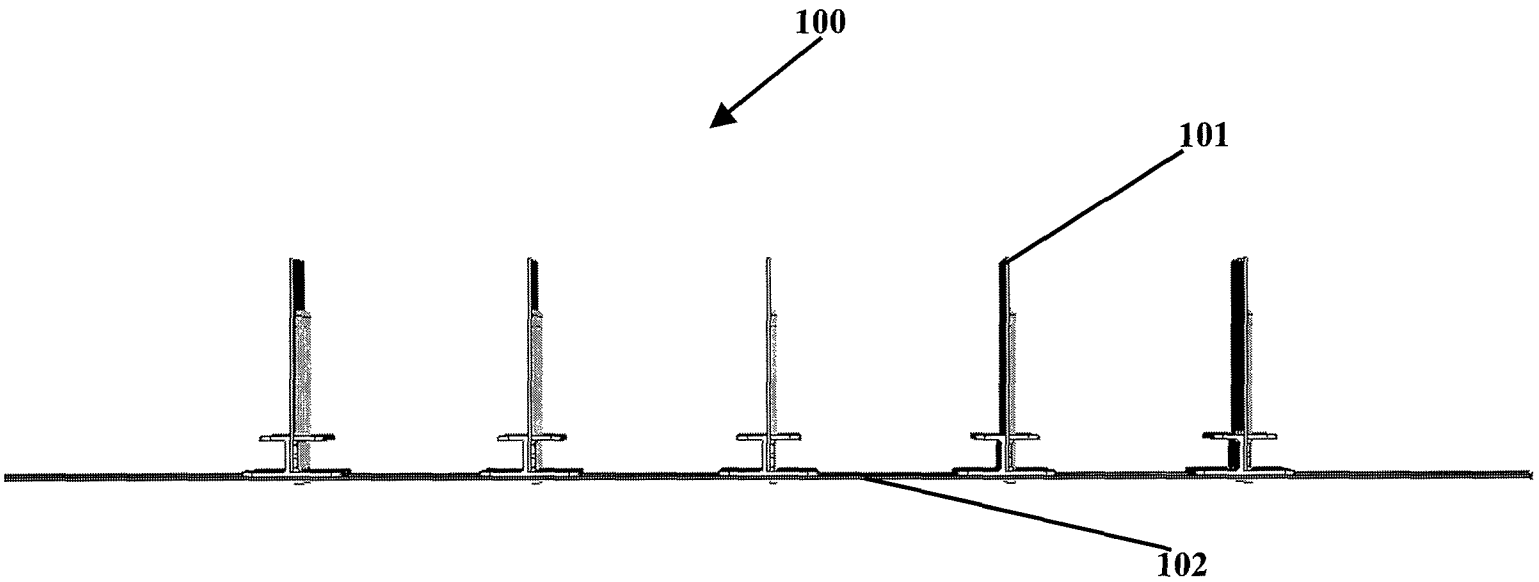
FIG. 3 illustrates a side view of the donor antenna of FIG. 1.

FIG. 3 illustrates a side view of the donor antenna 100 in FIG. 1. The side view of the donor antenna 100 shows the folded dipole antenna 101 arranged in 5 columns. Each of the folded dipole antenna 101 is also arranged in equidistance apart, as the distance will also affect the radiation pattern beam-width and overall gain of the donor antenna 100. The distance between the two folded dipole antennas 101 in a row is approximately 200-400 mm apart.

Figure 4:
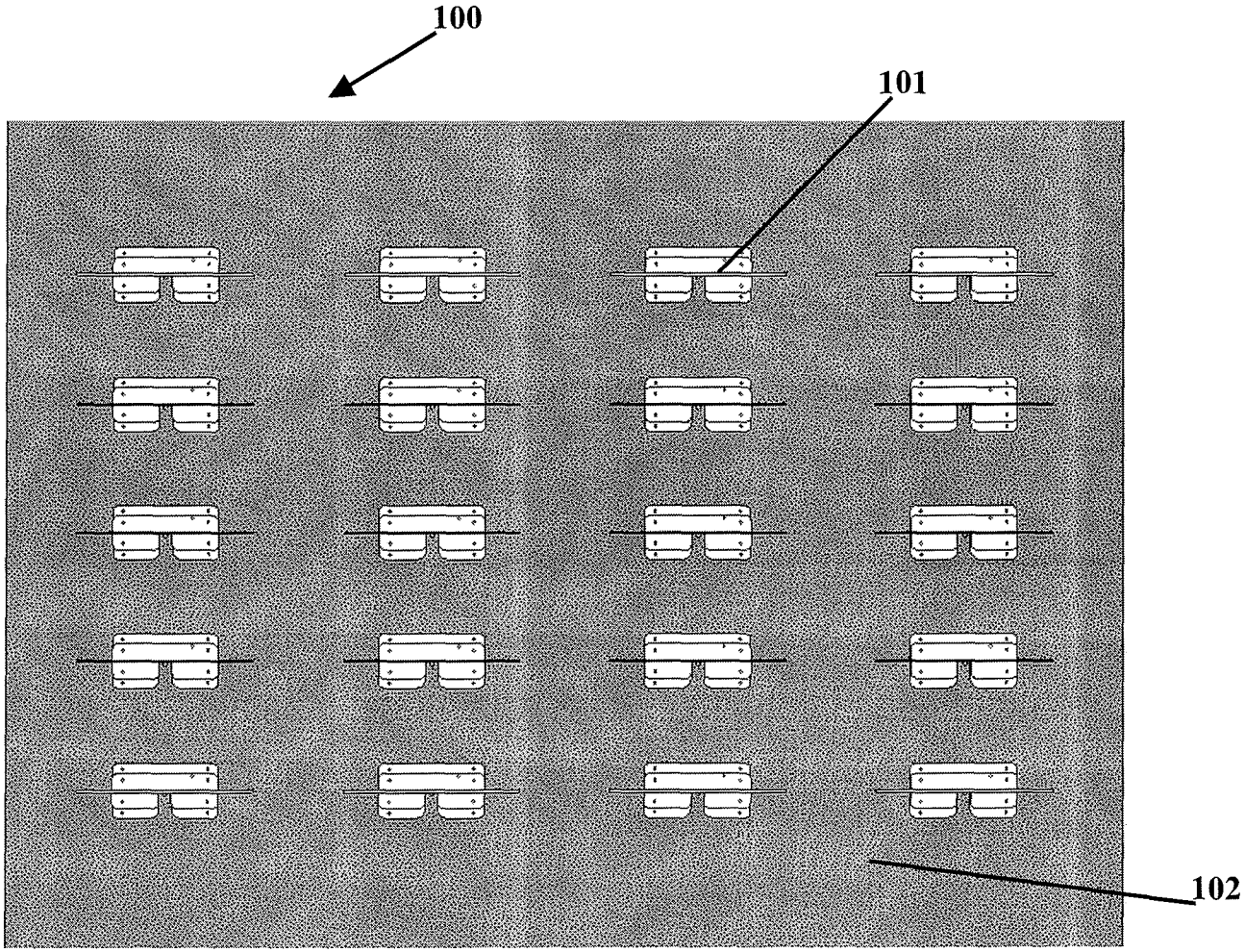
FIG. 4 exemplifies a top view of the donor antenna of FIG. 1 with the plurality of the folded dipole antennas arranged in the Rectangular lattice arrangement in accordance with one embodiment of the present invention.
Figure 5:
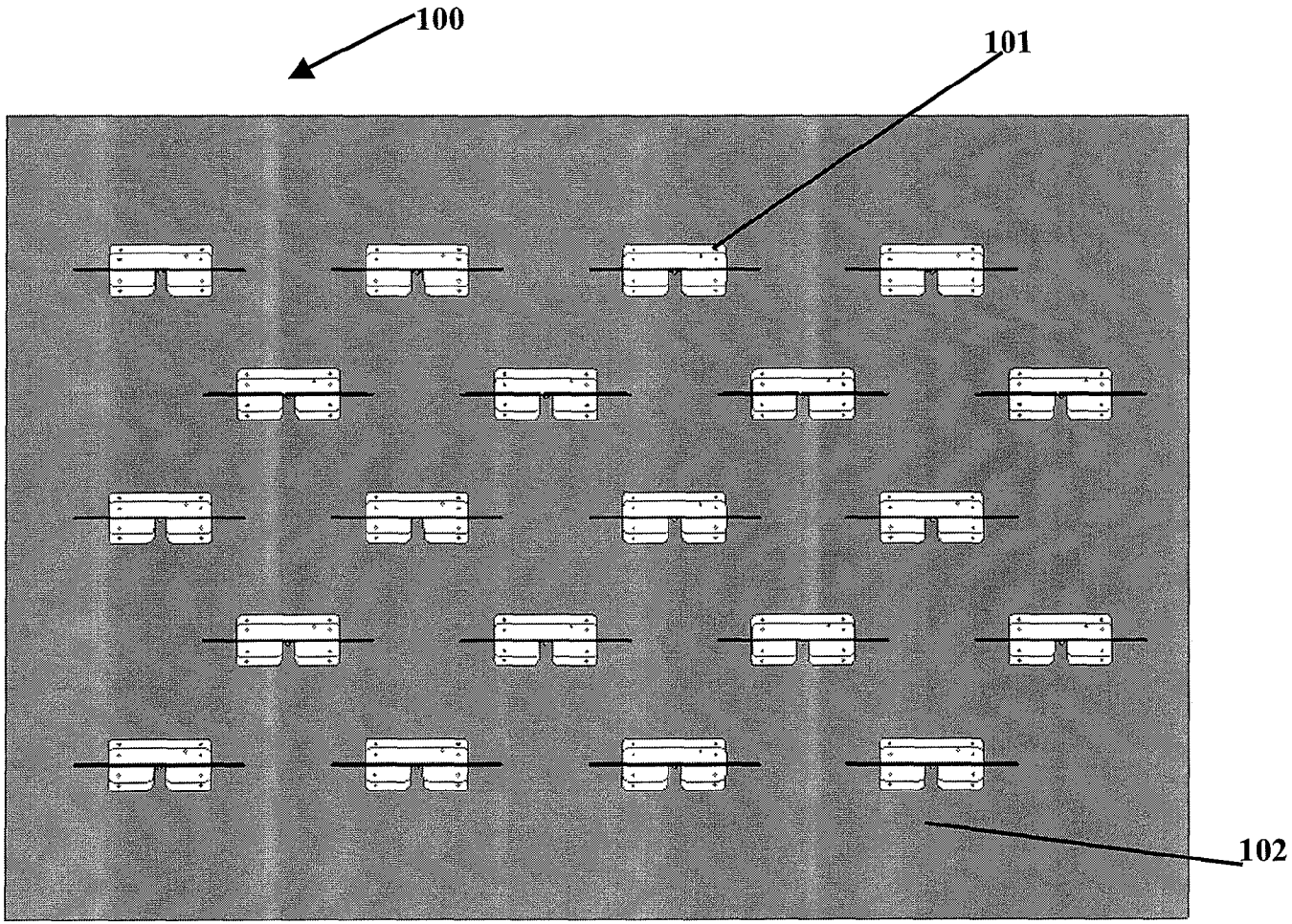
FIG. 5 exemplifies a top view of the donor antenna of FIG. 1 with the plurality of the folded dipole antennas arranged in a Triangular lattice arrangement in accordance with an alternative embodiment of the present invention.

FIG. 4 exemplifies a top view of the donor antenna 100 of FIG. 1 with the plurality of the folded dipole antennas 101 arranged in the Rectangular lattice arrangement in accordance with one embodiment of the present invention. This arrangement is similar as seen in FIG. 2-3, showing the other perspective views of the donor antenna 100.

FIG. 5 exemplifies a top view of the donor antenna 101 of FIG. 1 with the plurality of the folded dipole antennas 101 arranged in a Triangular lattice arrangement in accordance with an alternative embodiment of the present invention. Similarly, each of the folded dipole antenna 101 is placed vertically on the base plate 102, in a 4 rows by 5 columns (4×5) arrangement. The distance between two folded dipole antennas 101 arranged in line in each row is approximately 150-350 mm and arranged in line in each column approximately 400-500 mm.

Figure 6:
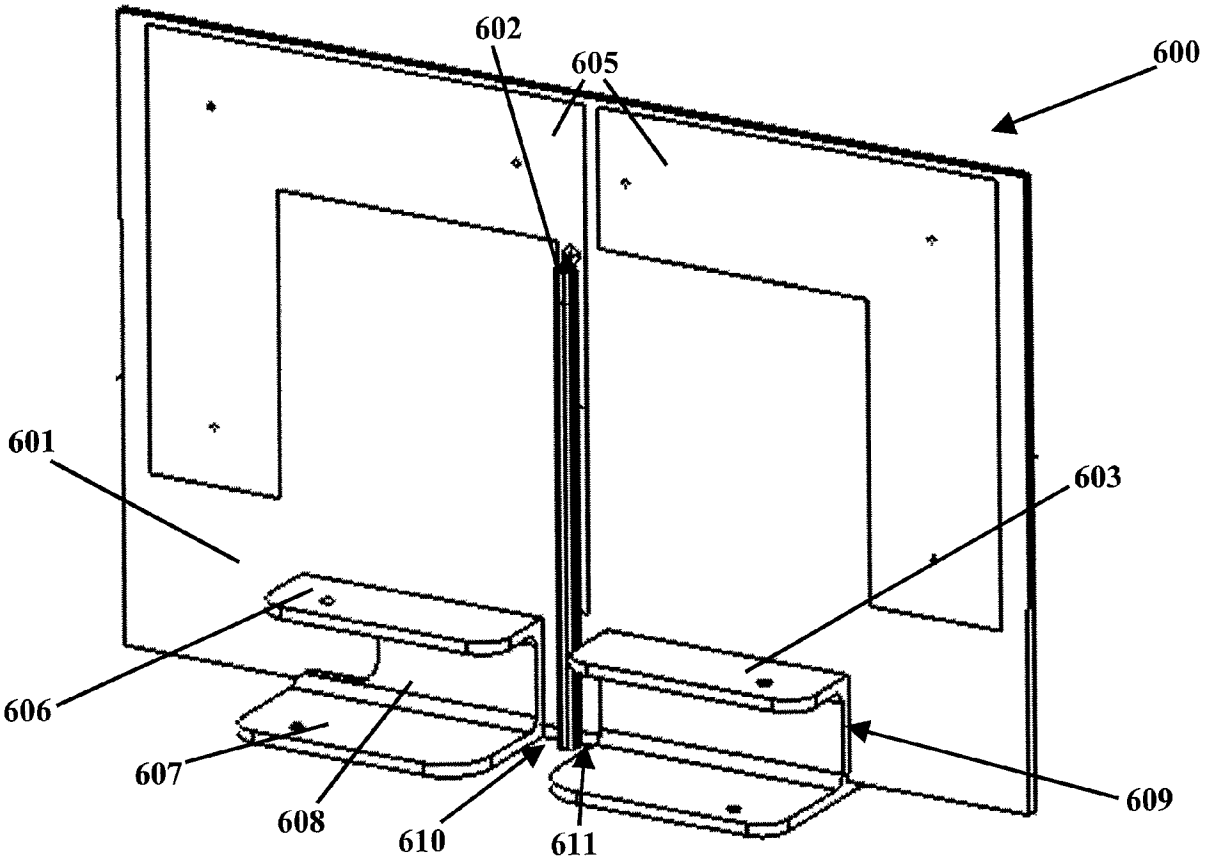
FIG. 6 illustrates an individual unit of the folded dipole antenna as shown in FIG. 1.

FIG. 6 illustrates an individual unit of the folded dipole antenna 600 as shown in FIG. 1 in accordance with an embodiment of the present invention. The folded dipole antenna 600 includes a folded dipole Printed Circuit Board (PCB) 601, a coaxial cable 602, a plastic holder 603 and a base plate 604. The folded dipole PCB 601 is mounted perpendicularly to the base plate 604 though the plastic holder 603 forming substantially an inverted-T cross-section. The coaxial cable 602 is soldered to the folded dipole PCB 601 at one end and extends towards the centre of the base plate 104. The folded dipole antenna 600 placed together with the base plate 604 becomes a directional antenna with an increase in the gain of the donor antenna in 100.

Still referring to FIG. 6, the folded dipole PCB 601 is substantially a rectangular shaped microstrip antenna with conducting strips 605 defined on both "dipole arms" of the folded dipole PCB 601. Further elaborations on the configurations of the conducting strips will be shown below. The plastic holder 603 includes an I-beam shaped plastic piece having an upper flange 606 and a lower flange 607 connected to a web 608. A slot 609 that cuts from the upper flange 606 into the web 608 is defined for receiving the folded dipole PCB 601 there between. One side of the plastic holder 603 has a cut-off area 610 for allowing the coaxial cable 602 to run through when it is attached to one dipole "arm" of the folded dipole PCB 601. The plastic holder 603 can be made from Acrylonitrile Butadiene Styrene (ABS) for example, which can be used as a support for holding the folded dipole PCB 601 onto the base plate 604. A through hole 611 is further provided on the base plate 604 to allow coaxial cable 602. A plurality of the through holes will be required on the base plate 604 as the plurality of folded dipole antenna 600 will be placed onto the base plate 604 to construct the donor antenna 100 as shown in FIG. 1.

Figure 7:
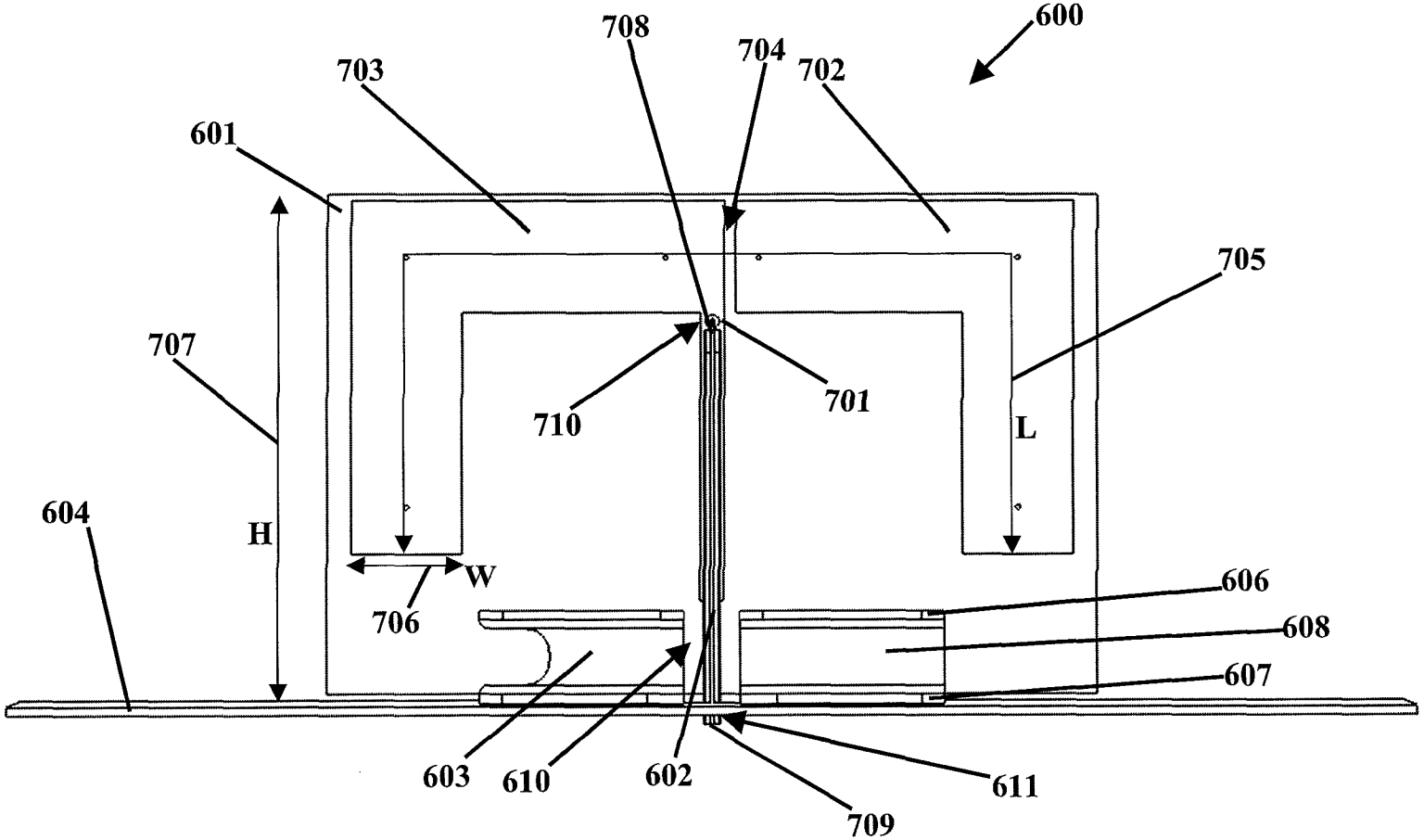
FIG. 7 shows a front view of the folded dipole antenna as shown in FIG. 6.

FIG. 7 shows a front view of the folded dipole antenna 600 as shown in FIG. 6, where the elements forming the conducting strips are illustrated with the respective dimensions. As shown, the folded dipole PCB 601 is mounted perpendicularly on the base plate 604. When mounted, the lower flange 607 of the plastic holder 603 is attached to the base plate 604. The folded dipole PCB 601 is sandwiched by the plastic holder 603 through the slot 609. When necessary, the folded dipole PCB 601 may further be secured on the plastic holder 603 through a snap-in pin or the like of the plastic holder 603. The cut-off area 610 allows the coaxial cable 602 to run through the plastic holder 603 to reach the base plate 604 when it is attached to the folded dipole PCB 601 to the base plate 604.

Still referring to FIG. 7, the folded dipole PCB 601 includes two symmetric "m"-shaped conducting strips formed on each side of a substrate of the folded dipole PCB 601 respectively constituting the antenna elements. One side of the "m"-shaped conducting strip is acted as a ground plane, whilst another is the antenna element that transmits the radio signals. Each "m"-shaped conducting strip is configured with a thicker width strip defined alongside the substrate of the folded dipole PCB 601 and a thinner width strip 701 extending downwardly from the center of the thicker width strip and runs towards the opposing side of the substrate. The thinner width strip 701 can be used to match the impedance of the folded dipole antenna 600 to the required signal source. In this embodiment, the length of the thinner width strip 701 is approximately 62 mm and its width is approximately 5 mm. The length of the thinner width strip 701 terminates before reaching the plastic holder 603. The "m"-shaped conducting strip further includes a first conducting strip 702 and a second conducting strip 703. The first conducting strip 702 and the second conducting strip 703 are separated by a gap 704, in a manner that the first conducting strip 702 defines an inverted "L" shaped strip and the second conducting strip 703 defines an inverted "U" shaped strip. For easy reference, the entire "m"-shaped conducting strip is measured with an average length, L 705, a width, W 706 and a height, H 707. For matching the impedance of the antenna in the present embodiment, the dimensions of the conducting strip can be approximately 240 mm for L 705, approximately 24 mm for the W 706 of the thicker conducting strips and approximately 200 mm for H 707.

As mentioned, the length, L 705, is dependant on half-wavelength, of the desired operating frequency of the folded dipole antenna 600. Preferably, the length, L 705 should be equal to a multiplicative of the half-wavelength. Similarly, the width, W 706, is also subjected to variations depending on the matching impedance to employ the desired operating frequency.

Still referring to FIG. 7, the coaxial cable 602 includes an upper terminal 708 at one end and a lower terminal 709 at the other end. The upper terminal 708 is soldered to a proximal end 710 towards an upper edge of the folded dipole PCB 601. The metal shield of the coaxial cable 602 is soldered along the thinner width strip 701 and is extended through the through hole 711. The lower terminal 709 is terminated with a connector, such as a SubMiniature version A (SMA) female connector.

Figure 8:
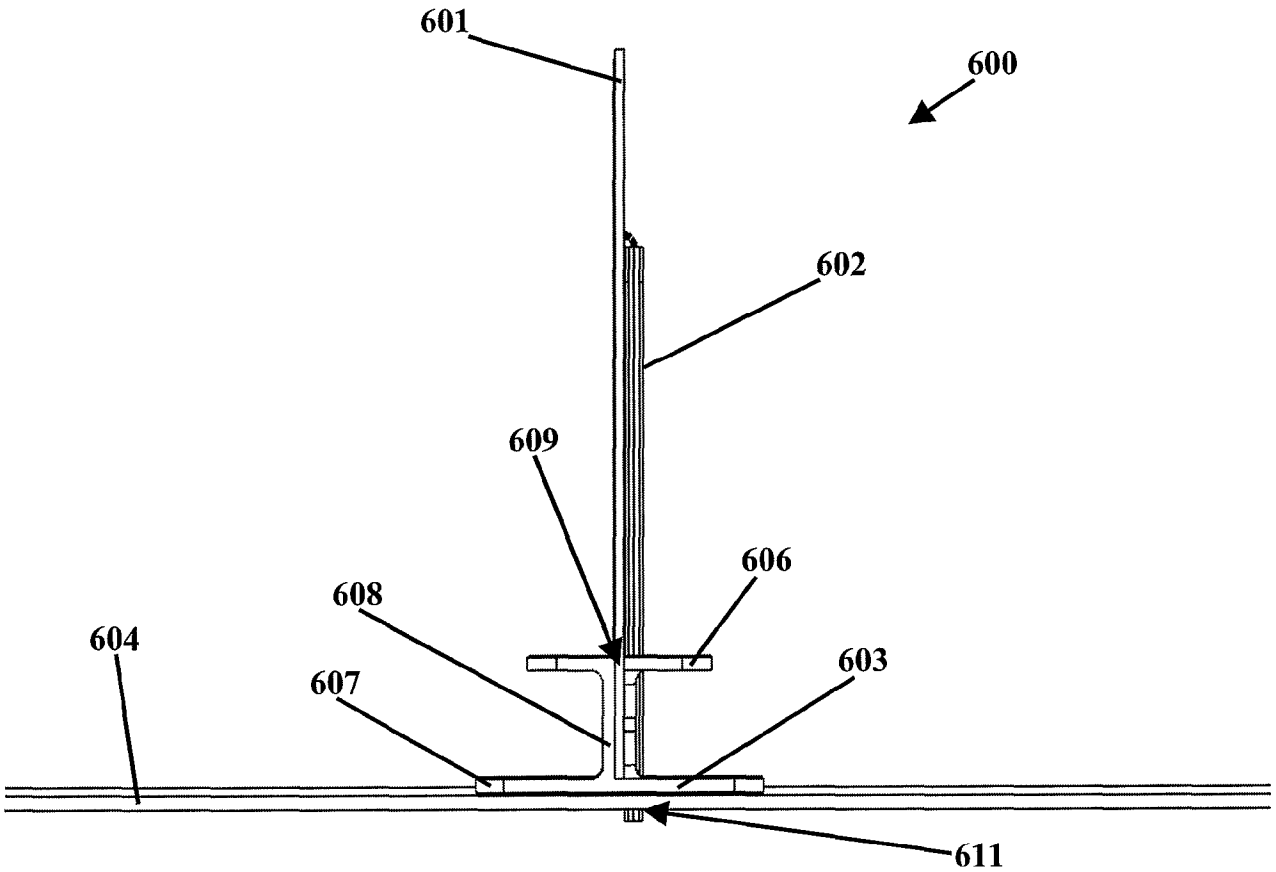
FIG. 8 shows a side view of the folded dipole antenna.

FIG. 8 shows a side view of the folded dipole antenna 600, where the inverted-T shaped crossed-section is shown. The coaxial cable 602 is soldered to the folded dipole PCB 601 on the "ground arm" where the first conducting strip 702 and the second conducting strip 703 is defined. The core conductor of the coaxial cable 602 is extended through the folded dipole PCB 601 and in electrical connection with the "excited arm" on the other side of the folded dipole PCB 601, and the metal shield of the coaxial cable 602 is electrically connected to the thinner strip at the "ground arm" side. The coaxial cable 602 runs downwardly along the thinner strip line and terminates with a connector that extends through the through hole 610 of the base plate 604, which ultimately grounds the "ground arm" side of the folded dipole PCB 601.

Figure 9:
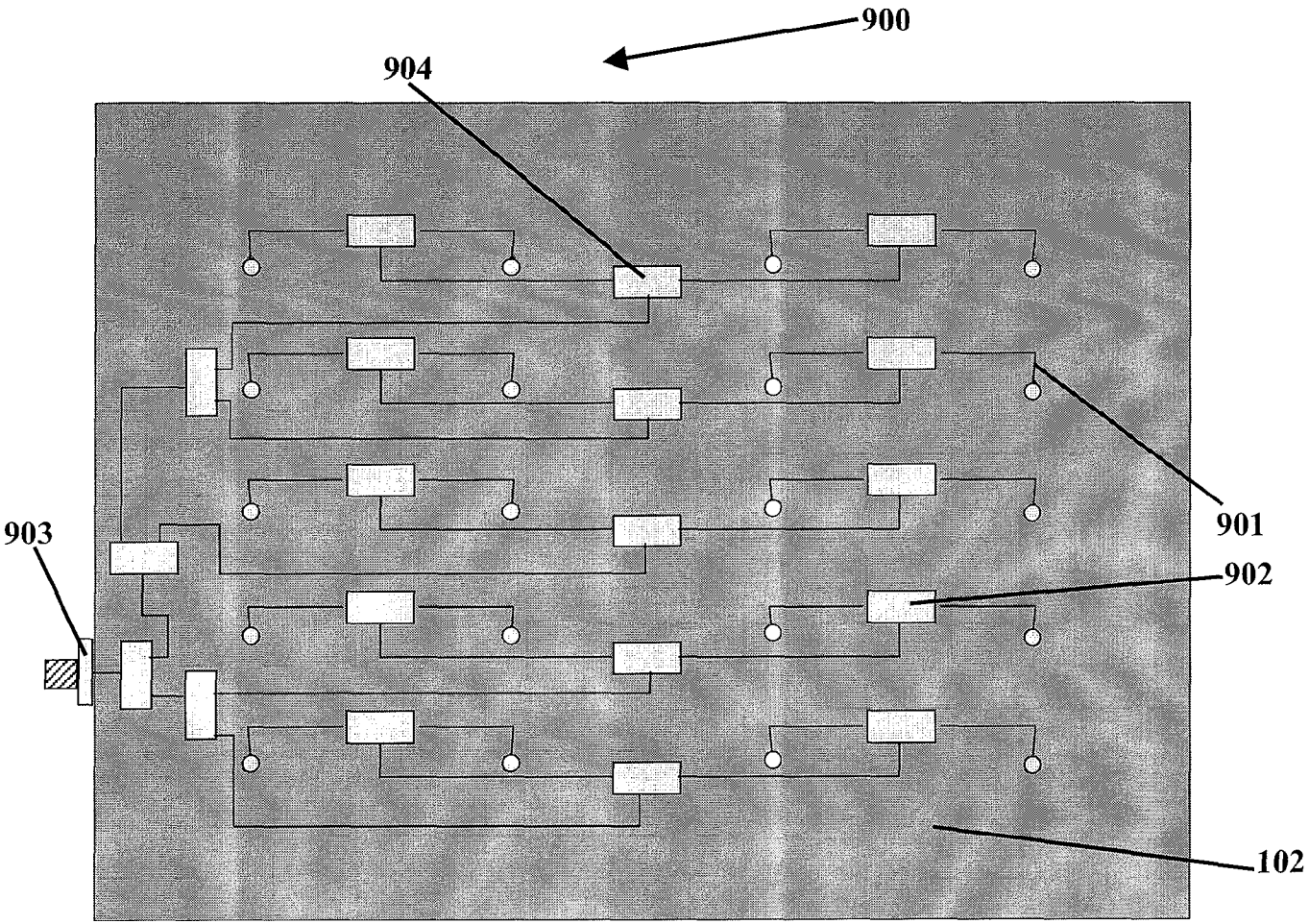
FIG. 9 illustrates a feed network located underneath the base plate of the donor antenna as shown in FIG. 1 in accordance with one embodiment of the present invention.

FIG. 9 illustrates a feed network 900 located underneath the base plate 102 of the donor antenna 100 as shown in FIG. 1 as one embodiment of the present invention. The feed network 900 as shown in FIG. 9 follows the Rectangular lattice arrangement. The feed network 900 includes a plurality of the semi-rigid coaxial cables 901, a plurality of power dividers 902 and a Deutsches Institut für Normung (DIN) connector 903. The feed network 900 is set up underneath the base plate 102 with the aim of isolating any radiation that may be radiating out of the feed network 900, reducing any interference with the radiation from the plurality of the folded dipole antennas 101.

In accordance with another embodiment, the feed network 900 can be formed on a PCB. In yet another embodiment, the power dividers may be formed with microstrip lines to create modules.

The semi-rigid coaxial cables 901 connecting each of the folded dipole antenna 101 are of equal lengths so that there will be no phase difference between each folded dipole antenna 101. It is optimal to attain no phase difference between each folded dipole antenna 101, as it will result in antenna radiation pattern distortion. The power dividers 902 operate to divide the Radio Frequency (RF) input power at a certain power ratio between the folded dipole antennas 101. A radiation pattern synthesis to get the best radiation pattern in terms of high gain and high front to back ratio for the donor antenna 100 defines the design of the power divider 902. Another factor in the design of the power divider 902 matches the impedance between the input port and output ports. The DIN connector 903 is a connector typically used in analog applications. The DIN connector 903 used as an example is a 7/16 DIN connector. The DIN connector 903 is a T shape box connected outside the left side of the donor antenna 100 and crimped to the semi-rigid coaxial cables 901. The semi-rigid coaxial cables 901, the power dividers 902 and the DIN connector 903 are all connected to form the feed network 900 of the donor antenna 100.

Still referring to FIG. 9, as mentioned above, the Rectangular lattice comprises an array of folded dipole antennas 101 arranged in 4 rows and 5 columns. In each column, a pair of the adjacent folded dipole antenna 101 with each of its coaxial cable 602 extended through the through hole 610, is connected to one power divider 902. Accordingly, the four folded dipole antennas 101 in each column require two power dividers 902. The two power dividers 902 connecting the two pair of folded dipole antennas 101 are further connected together with another power divider 902.

Given 5 columns in each donor antenna 100, five more power dividers 904 would be required. Following that, the power dividers 904 of the two outer pairs of columns of folded dipole antenna 101 are connected together with a further respective power divider 902. The power divider 902 of center column is then connected to one of the power dividers 902 of outer column pairs through yet another power divider 902. Finally, the power dividers 902 where the three columns connected thereto are connected to the power dividers 902 connecting the remaining column pair of folded dipole antenna 101 with a last power divider 902. The last power divider 902 terminates with the DIN connector 903 to form the feeder network. The connections between the folded dipole antennas 101 and the power dividers 902, and between the respective power dividers 902 are though semi-rigid coaxial cable 901.

The VSWR of the donor antenna 100 is less than 1.5. The front-to-back ratio, which measures the power gain between the front and the rear of a directional antenna, is greater than 33 dB. The present invention can achieve better front-to-back ratio to decrease noise as compared to other traditional designs of CDMA 450.

The dimension of the donor antenna 100 in the present embodiment is suitable to be fixed on communication tower, vertical surfaces on rooftop and monopole tower unlike other traditional designs of antennas that operates at the same 450-470 MHz range. The total weight of the donor antenna 100 is approximately ≤40 Kg.

The present invention increases the gain and the front-to-back ratio by adopting an array of folded dipole antenna 101 in a vertical and horizontal axis which increase the donor antenna's 100 in the vertical and horizontal axis. The present invention is also able to improve the gain and front-to-back ratio by implementing radiation pattern synthesis at the feed network 900 of the donor antenna 100. The directivity of the radiation pattern will be more focus thus increasing the donor antenna's 100 gain and reducing back radiation of the donor antenna 100. The donor antenna 100 is of a planar type of antenna, which is uncommon for low frequency antenna such as a 450 MHz frequency. The donor antenna 100 achieves high gain and high directivity with a good coverage of the CDMA 450 frequency and a good VSWR.

The above description illustrates various embodiments of the present invention along with examples of how aspects of the present invention may be implemented. While specific embodiments have been described and illustrated it is understood that many charges, modifications, variations and combinations thereof could be made to the present invention without departing from the scope of the present invention. The above examples, embodiments, instructions semantics, and drawings should not be deemed to be the only embodiments, and are presented to illustrate the flexibility and advantages of the present invention as defined by the following claims:

The invention claimed is:

1. A donor antenna comprising:

a base plate having a top surface and a bottom surface;

an array of folded dipole antennas mounted on the top surface of the base plate through a plastic holder, wherein the array of folded dipole antennas are arranged in a lattice form; and a feed network defining on the bottom surface for electrically connecting the array of folded dipole antenna to collectively feed to a connector, wherein each of the folded dipole antenna comprises a substrate having symmetrically configured conducting strips defined on the both side of the substrate forming an excitation arm and a ground arm of the folded dipole antenna.

2. A donor antenna of claim 1, wherein the lattice form comprises a 4 by 5 array of folded dipole antennas.

3. A donor antenna of claim 1, wherein each of the folded dipole antenna are mounted perpendicularly to the base plate.

4. A donor antenna of claim 1, wherein both excitation arm and the grounding arm are adapted with a symmetric conducting strip configuration, wherein the conducting strip on each side of the substrate comprises a m-shaped conducting strip having a center conducting leg, and two symmetrically configured folded arms, wherein the center conducting leg is thinner in width than the two folded arms.

5. A donor antenna of claim 4, wherein each of the folded dipole antenna comprises a coaxial cable having a center core extended through the substrate to connect with the excitation arm at one end, and a metal shield soldered along the center conducting leg of the ground arm, wherein the other end of the coaxial cable is extending through the base plate to electrically connect to the feed network on the bottom side of the base plate.

6. A donor antenna of claim 4, wherein the m-shaped conducting strip defining a gap separating the symmetrically configured folded arms of the m-shaped conducting strip into a first conducting strip and a second conducting strip, the first conducting strip includes one of the symmetrically configured folded arm and the center conducting leg forming an inverted U-shaped conducting strip whilst the second conducting strip include the other symmetrically configured folded arm forming an inverted L-shaped conducting strip.

7. A donor antenna of claim 1, wherein each folded dipole antenna is approximately 200-400 mm apart from the adjacent antenna.

8. A donor antenna of claim 1, wherein each row of the folded dipole antenna is approximately 150-400 mm apart from the adjacent row.

9. A donor antenna of claim 1, wherein the array of the folded dipole antennas is arranged in a rectangular lattice arrangement.

10. A donor antenna of claim 1, wherein the array of the folded dipole antennas is arranged in a triangular lattice arrangement.

11. A donor antenna of claim 1, wherein the feed network can be formed on a Printed Circuit Board.

12. A donor antenna of claim 1, wherein the feed network comprises a plurality of power dividers for collectively connecting the folded dipole antennas to feed to the connector.

13. A donor antenna of claim 12, wherein the plurality of power dividers can be further formed with microstrip lines to create modules.

14. A donor antenna of claim 12, wherein each adjacent pair of the folded dipole antennas is connected to one power divider.

* * * * *